US011293254B2

(12) United States Patent
Zhang et al.

(10) Patent No.: US 11,293,254 B2
(45) Date of Patent: Apr. 5, 2022

(54) EXPANSION TOOL ASSEMBLY FOR EXPANDABLE TUBULAR

(71) Applicants: China National Petroleum Corporation, Beijing (CN); CNPC Engineering Technology R&D Company Limited, Beijing (CN)

(72) Inventors: Quanli Zhang, Beijing (CN); Binggui Xu, Beijing (CN); Depei Shi, Beijing (CN); Hongwei Yin, Beijing (CN); Huijuan Guo, Beijing (CN); Guodong Zhan, Dhahran (SA); Wanjun Li, Beijing (CN); Jianhua Guo, Chengdu (CN); Tao Jia, Beijing (CN); Fei Han, Beijing (CN); Jianli Wang, Beijing (CN); Yingjie Zhu, Beijing (CN); Mingjie Lv, Beijing (CN); Yi Yang, Beijing (CN); Yongliang Yu, Beijing (CN); Zhitong Liu, Beijing (CN); Fuxiang Hou, Beijing (CN); Zhijian Hu, Beijing (CN)

(73) Assignees: China National Petroleum Corporation, Beijing (CN); CNPC Engineering Technology R&D Company Limited, Beijing (CN)

( * ) Notice: Subject to any disclaimer, the term of this patent is extended or adjusted under 35 U.S.C. 154(b) by 43 days.

(21) Appl. No.: 16/908,898

(22) Filed: Jun. 23, 2020

(65) Prior Publication Data

US 2021/0396092 A1 Dec. 23, 2021

(51) Int. Cl.
*E21B 33/12* (2006.01)
*E21B 33/1295* (2006.01)

(52) U.S. Cl.
CPC ..... *E21B 33/1208* (2013.01); *E21B 33/1295* (2013.01)

(58) Field of Classification Search
CPC ..... E21B 33/128; E21B 33/1208; E21B 33/1295; E21B 43/103; E21B 43/105; E21B 43/108
See application file for complete search history.

(56) References Cited

U.S. PATENT DOCUMENTS 3,818,734 A * 6/1974 Bateman ..... E21B 43/105 72/75
2002/0066578 A1* 6/2002 Broome ..... E21B 43/103 166/386

(Continued)

FOREIGN PATENT DOCUMENTS

CN 201567994 U 9/2010
CN 101915059 B 12/2011

(Continued)

*Primary Examiner* — David Carroll
(74) *Attorney, Agent, or Firm* — Volpe Koenig

(57) ABSTRACT

Disclosed are an expansion tool assembly, comprising: an expandable tubular; a guide shoe partially inserted into and connected to the lower end of the expandable tubular; a sealing sleeve arranged in the expandable tubular and connected to the upper end of the guide shoe; an expansion assembly comprising an expansion cone and expansion seat disposed inside the expandable tubular, wherein the lower end of the expansion seat is connected with hooks, which can be rested on the upper end of the sealing sleeve; an upper joint that is connected to the upper end of the expansion seat and can be connected to a drill string. A force transfer path can be established via connection between the expansion seat and sealing sleeve, so that expandable tubular weight is borne on the drill string. Unintentional expansion of the expandable tubular, caused by interaction between expandable tubular and expansion cone, can be avoided.

11 Claims, 5 Drawing Sheets

(56) References Cited

U.S. PATENT DOCUMENTS

| | | | | |
|---|---|---|---|---|
| 2004/0045718 | A1* | 3/2004 | Brisco | E21B 43/105 166/380 |
| 2005/0028987 | A1* | 2/2005 | Watson | E21B 43/103 166/380 |
| 2018/0202267 | A1* | 7/2018 | Xu | E21B 29/10 |

FOREIGN PATENT DOCUMENTS

| | | | |
|---|---|---|---|
| CN | 101718179 | B | 10/2012 |
| CN | 103375141 | B | 8/2016 |
| CN | 105484695 | B | 10/2018 |

* cited by examiner

EXPANSION TOOL ASSEMBLY FOR EXPANDABLE TUBULAR

FIELD

The present invention relates to the field of drilling or earth boring, in particular to an expansion tool assembly for expandable tubular.

BACKGROUND

In the drilling process, problems may occur owing to the formation natural structure and formation pressure, resulting in complicated situations such as drilling fluid leakage and well wall collapse. Conventional plugging approach by chemical means is time-consuming and not always works, consequently increases the operation cost, and imposes significant delays to the drilling operation.

Using expandable tubular technology to perform physical or mechanical isolation for complex well sections and install temporary cased wellbore can effectively eliminate the leakage and or borehole collapse during continued drilling and provide safe and reliable guarantee for normal drilling in the drilling process.

An expandable tubular string mainly comprises an expandable tubular, an expansion cone, and an associated downhole tool, etc. The expansion tool assembly is connected to the drill string, the expandable tubular is lowered into a complex well section by the drill string, and the expansion cone is normally pushed under a large hydraulic pressure to move inside and along the expandable tubular, so that the expandable tubular is plastically deformed or expanded and may tightly be in contact with the wellbore wall, or a well section is mechanically isolated with or without a cementing option.

If the expandable tubular string is stuck during the lowering process and has to be lifted up or get free, the expandable tubular carried in hole in a traditional approach may be expanded unintentionally owing to the self-weight of the expandable tubular plus the applied overpull force to free up the stuck string, i.e. the expandable tubular may be expanded before it reaches to the target position. Consequently, it results in a lost time. In addition, the expansion may be unable to expand further during the expansion process owing to unpredictable and complicated wellbore conditions. In such a case, subsequent measures or rig remedial actions can't be taken if the work drill string can't be disengaged from the expansion cone, again resulting in more lost time.

Therefore, it is necessary to optimize the design of the expansion tool assembly to make the downhole tubular expansion operation safer and more reliable.

SUMMARY

The object of the present invention is to provide an innovative expansion tool assembly for expandable tubular, so as to solve the problems described above.

To achieve the above object, the present invention provides an expansion tool assembly for expandable tubular, which comprises:

an expandable tubular;

a guide shoe partially inserted into and connected to the lower end of the expandable tubular;

a sealing sleeve arranged in the expandable tubular and connected to the upper end of the guide shoe;

an expansion tool assembly comprising an expansion cone and an expansion seat disposed inside the expandable tubular, wherein the lower end of the expansion seat is connected with hooks or commonly called collet fingers, which can be rested on the upper end of the sealing sleeve;

an upper joint that is connected to the upper end of the expansion seat and can be connected to a drill string.

Optionally, the lower end of the expansion seat is connected with a plurality of hooks arranged at an interval in the circumferential direction, the inner wall of the upper end of the sealing sleeve is provided with grooves, and the hooks are inserted into the upper end of the sealing sleeve and engaged in the grooves.

Optionally, the hooks can move elastically in the radial direction (so to release).

Optionally, the expansion tool assembly for expandable tubular comprises a plug seat disposed inside the expandable tubular, wherein the lower end of the plug seat is connected with the guide shoe, and the plurality of hooks surround the plug seat.

Optionally, the outer circumferential surface of the plug seat is provided with annular protrusions for supporting the hooks.

Optionally, the upper end of the plug seat is sealingly inserted into the expansion seat, the lower end of the plug seat is sealingly inserted into the guide shoe, and the plug seat and the guide shoe are connected via a radially extending shear pin, wherein the plug seat can shear off the shear pin under the action of downward pressure and move downward with respect to the guide shoe to allow the expansion seat to move, after the annular protrusions disengage from the hooks.

Optionally, the expansion tool assembly for expandable tubular comprises a drill string plug, which can be displaced along the drill string and can move into the plug seat under downward hydraulic pressure to achieve a pressure seal.

Optionally, the lower end of the expansion seat is spline-fitted with the sealing sleeve, the expansion seat can move axially with respect to the sealing sleeve, and the upper joint can be detachably connected with the expansion seat through threads.

Optionally, the guide shoe comprises a tubular portion inserted into the expandable tubular and a ball head portion located outside the expandable tubular, a stepped surface supporting the lower end of the expandable tubular is formed between the ball head portion and the tubular portion, and the tubular portion is connected with the expandable tubular through threads.

Optionally, the expandable tubular comprises a first section, a second section, and a third section, which are sequentially arranged from bottom to top, wherein the outer diameter of the first section is greater than that of the third section, and the outer diameter of the second section is reduced in the direction from the first section to the third section.

Optionally, the expansion cone is supported on the upper side of the expansion seat, and the expansion cone is at least partially positioned in the second section.

Optionally, the drill string comprises a work drill string and a double-box connector connected to the lower end of the work drill string, wherein the double-box connector can be clamped to the upper joint.

With the above technical scheme, a force transfer path is established via the connection between the expansion seat and the sealing sleeve, so that the weight of the expandable tubular is borne on the drill string instead of the expansion cone, thereby the expansion of the expandable tubular unintentionally, which is caused by the interaction between the expandable tubular and the expansion cone, can be avoided; in addition, the expansion seat and the sealing sleeve can be spline-fitted, so that the threaded connection between the upper joint and the expansion seat can be disconnected, and the upper joint and the drill string can be extracted from the expandable tubular when the expandable tubular is stuck and can't be expanded.

REFERENCE NUMBERS

Figure 1:
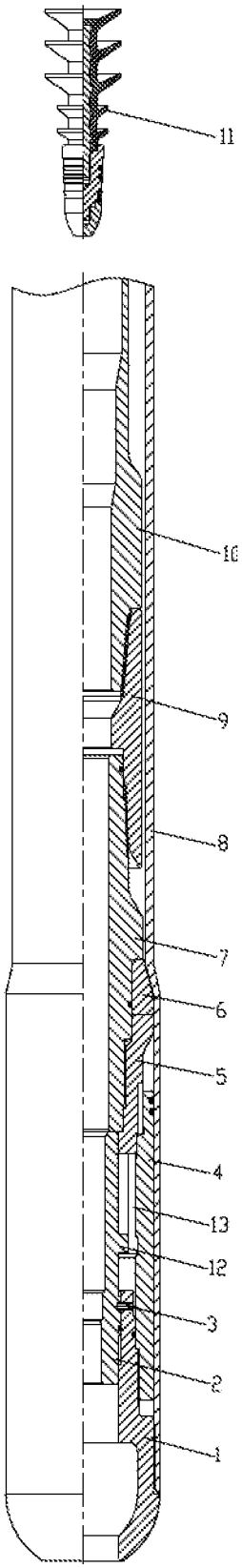
FIG. 1 is a cross-sectional view of the expansion tool assembly for expandable tubular connected with a drill string in an embodiment of the present invention.
Figure 2:
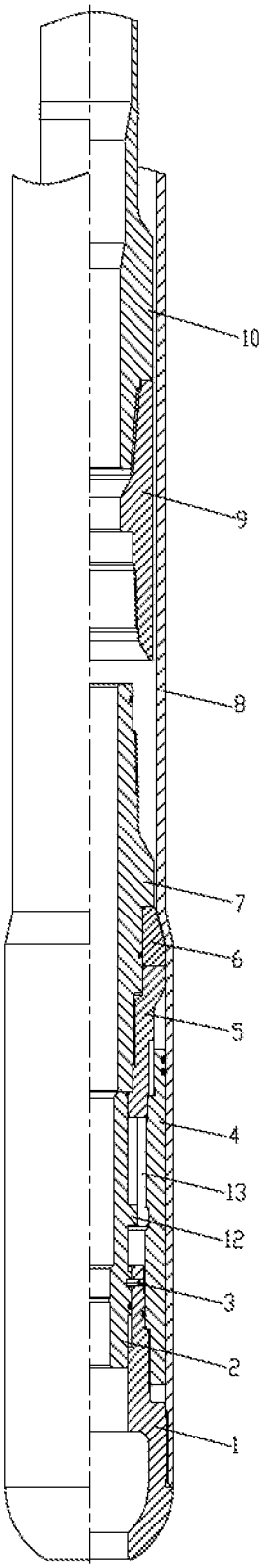
FIG. 2 is a cross-sectional view of the expansion tool assembly for expandable tubular not connected with the drill string in an embodiment of the present invention.

| | |
|---|---|
| 1 guide shoe | 2 plug seat |
| 3 shear pin | 4 sealing sleeve |
| 5 expansion seat | 6 expansion cone |
| 7 upper joint | 8 expandable tubular |
| 9 double-box connector | 10 work drill string |
| 11 drill string plug | 12 annular protrusion (or hook supporter) |
| 13 hook | |

DETAILED DESCRIPTION

Hereunder some embodiments of the present invention will be detailed with reference to the accompanying drawings. It should be understood that the embodiments described herein are only provided to describe and explain the present invention rather than constitute any limitation to the present invention.

In the present invention, unless otherwise specified, the terms that indicate orientations, such as "top" and "bottom", etc., generally refer to the positional relationship of the expandable tubular after the expandable tubular enters the wellbore, while "axial", "radial" and "circumferential" make reference to the central axis of the expandable tubular.

The present invention provides an expansion tool assembly for expandable tubular, which comprises:

an expandable tubular 8;

a guide shoe 1 partially inserted into and connected to the lower end of the expandable tubular 8;

a sealing sleeve 4 arranged in the expandable tubular 8 and connected to the upper end of the guide shoe 1;

an expansion assembly comprising an expansion cone 6 and an expansion seat 5 disposed inside the expandable tubular 8, wherein the lower end of the expansion seat 5 is connected with hooks 13, which can be rested on the upper end of the sealing sleeve 4;

an upper joint 7 that is connected to the upper end of the expansion seat 5 and can be connected to a drill string.

The expansion tool assembly for expandable tubular is used for mitigating wellbore problems. After the expandable tubular is lowered to the target section of wellbore, the expandable tubular is expanded (the inner diameter and outer diameter are increased) by means of the expansion assembly, so that the expanded tubular provides a cased hole conduit with a sufficient pass-through diameter for continued drilling operation while achieving isolation of problem well section.

As shown in FIG. 1, the guide shoe 1 is inserted into and connected to the lower end of the expandable tubular 8 to attain a guiding effect as well as provide a weight carrying point for the expandable tubular 8; the sealing sleeve 4 has a tubular structure, the outer circumferential surface of the sealing sleeve 4 is tightly attached to the inner circumferential surface of the expandable tubular 8 to realize sealing, and the upper end of the guide shoe 1 can be inserted into the lower end of the sealing sleeve 4, so that the guide shoe 1 and the sealing sleeve 4 are connected with each other and thereby the sealing sleeve 4 can provide upward pulling force for the guide shoe 1; the expansion seat 5 in the expansion assembly is also generally in a tubular shape, and the lower end of the expansion seat 5 is connected with hooks 13, which can be rested on the upper end of the sealing sleeve 4 inside the groove to provide upward pulling force; the expansion cone 6 can move axially in the expandable tubular 8 to expand the inner diameter and outer diameter of the expandable tubular 8 so as to realize expansion; the upper joint 7 is generally in a tubular shape, and its lower end is connected to the upper end of the expansion seat 5 to provide upward pulling force, and can be connected to the drill string.

Through field experience and published literature, it is known that the reason why the expandable tubular is expanded unintentionally lies in: the expandable tubular weight is traditionally borne on the expansion cone. In the case that the length and weight of the expandable tubular are substantially great, the supporting force of the expansion cone to the expandable tubular also increases. When the interaction force is greater than the expansion force of the expandable tubular, the expandable tubular will expand. In this scheme, when the drill string is inserted into the expandable tubular 8 and connected to the upper joint 7, a force transfer path through the drill string, the upper joint 7, the expansion seat 5, the sealing sleeve 4, the guide shoe 1 and the expandable tubular 8 in sequence can be formed, i.e., the expandable tubular 8 provides upward pulling force via the drill string instead of the expansion cone 6, thus the expandable tubular 8 is prevented from sliding downward with respect to the expansion cone due to excessive gravity and consequently expanded unintentionally by the expansion cone 6.

Furthermore, the lower end of the expansion seat 5 is connected with the plurality of hooks 13 arranged at an interval in the circumferential direction, the inner wall of the upper end of the sealing sleeve 4 is provided with grooves, and the hooks 13 are inserted into the upper end of the sealing sleeve 4 and rested in the grooves. The plurality of hooks 13 may be formed by forming a plurality of notches spaced apart circumferentially in a tubular part (the tubular portion at the lower end of the expansion seat 5), and protruding hook portions are formed on the outer circumference of the hooks 13, the hooks 13 are located in the sealing sleeve 4, and grooves may be formed in the inner wall of the sealing sleeve 4 to receive the hook portions, so that the hooks 13 can provide upward pulling force to the sealing sleeve 4.

Optionally, the hooks 13 can move elastically in the radial direction. When the expansion seat 5 is pulled upward with respect to the sealing sleeve 4, the hooks 13 may deform inward radially to disengage from the grooves in the sealing sleeve 4 after the plug seat 2 together with the annular protrusion 12 is moved downward, so that the expansion seat 5 disengages from the sealing sleeve 4, and the expansion seat 5 and the expansion cone 6 can move upward with respect to the expandable tubular 8 to expand the expandable tubular 8.

Furthermore, the expansion tool assembly for expandable tubular comprises a plug seat 2 disposed inside the expandable tubular 8, wherein the lower end of the plug seat 2 is connected with the guide shoe 1, and the plurality of hooks 13 surround the plug seat 2. The hooks 13 can be supported outward radially by the plug seat 2 and are prevented from bending inward radially, since the hooks 13 are forced to be inserted into the grooves of the sealing sleeve 4.

Furthermore, the outer circumferential surface of the plug seat 2 is provided with annular protrusions 12 for supporting the hooks 13. As shown in FIGS. 1-5, the plug seat 2 is generally in a tubular shape, and annular protrusions 12 are formed on the outer circumference of the plug seat 2. The annular protrusions 12 extend in the circumferential direction, and have a greater outer diameter when compared with other portions of the plug seat 2 so as to support the hooks 13 better.

Figure 4:
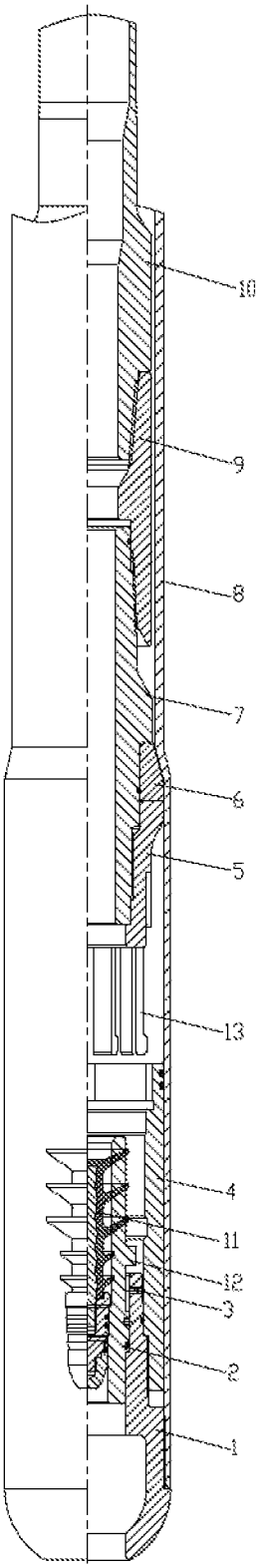
FIG. 4 is a cross-sectional view of the expansion tool assembly for expandable tubular in the embodiment of the present invention, wherein the expandable tubular is in the process of being expanded by the expansion cone.

Optionally, the upper end of the plug seat 2 is sealingly inserted into the expansion seat 5, the lower end of the plug seat 2 is sealingly inserted into the guide shoe 1, and the plug seat 2 and the guide shoe 1 are connected via a radially extending shear pin 3, wherein the plug seat 2 can shear off the shear pin 3 under the action of downward pressure and move downward with respect to the guide shoe 1 to disengage from the expansion seat 5, after the annular protrusions 12 disengage from the hooks 13. The two ends of the plug seat 2 provides the connection seal between the expansion seat 5 and the guide shoe 1 respectively, and thereby prevent drilling fluid from entering the space between the expansion seat 5 and the guide shoe 1. When the plug seat 2 is under downward pressure (e.g., under the action of the drill string plug 11 landed, described below), the shear pin 3 between the plug seat 2 and the guide shoe 1 is sheared off, and the plug seat 2 can move downward axially, thereby the upper end of the plug seat 2 can disengage from the expansion seat 5 and allow drilling fluid to enter the lower end of the expansion seat 5, thus the expansion seat 5 is pushed to move upward and drives the expansion cone 6 described above, so that the expandable tubular 8 is expanded, as shown in FIG. 4. In addition, when the plug seat 2 moves downward, the annular protrusions 12 also disengage from the hooks 13 and no longer support or prevent movement of the hooks 13, thus the hooks 13 can be moved inward radially to disengage or pull out from the grooves of the sealing sleeve 4, and the expansion seat 5 is disconnected from the sealing sleeve 4, so that the expansion seat 5 can move upward with respect to the expandable tubular 8.

Figure 3:
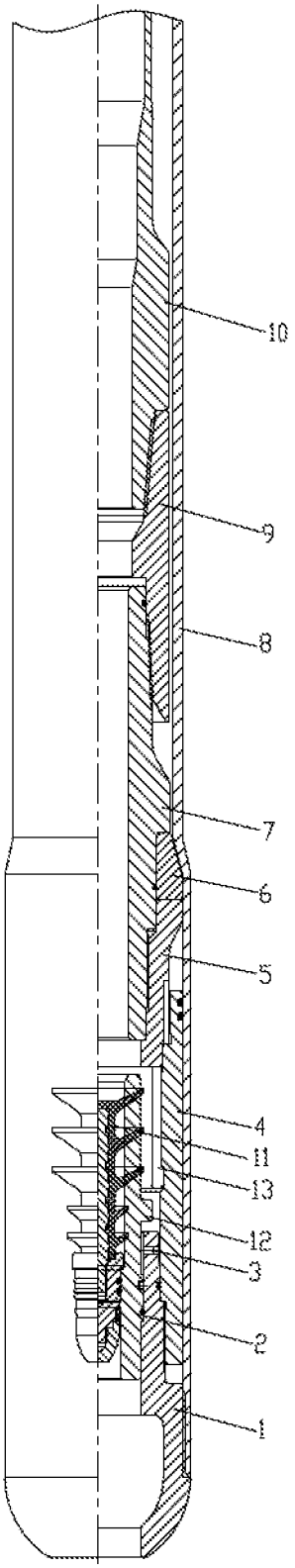
FIG. 3 is a cross-sectional view of the expansion tool assembly for expandable tubular in the embodiment of the present invention, with the plug seat disconnected from the hook.

Furthermore, the expansion tool assembly for expandable tubular comprises a drill string plug 11, which can be displaced along the drill string and can move into the plug seat 2 under downward pressure and exert downward pressure on the plug seat 2. The expansion tool assembly for expandable tubular can be connected to the drill string via an upper joint 7 to feed the expandable tubular to a target position in the wellbore by means of the drill string. The drill string plug 11 can be displaced along the drill string, and can pass through the upper joint 7 and enter the plug seat 2 under the action of pressure, and continue pushing the plug seat 2 downward, so that the shear pin 3 is sheared off, as shown in FIG. 3. By injecting drilling fluid into the drill string, downward pressure is applied to the drill string plug 11.

Figure 5:
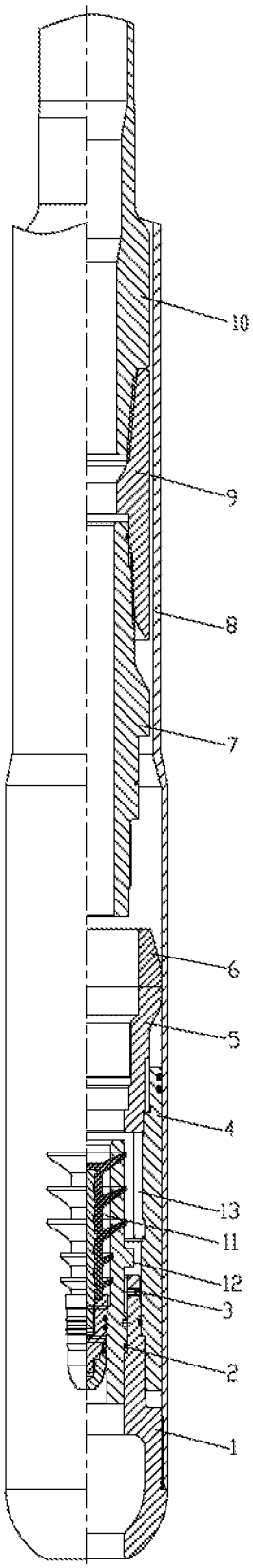
FIG. 5 is a cross-sectional view of the expansion tool assembly for expandable tubular in the embodiment of the present invention, with the upper joint disconnected from the expansion seat.

Optionally, the lower end of the expansion seat 5 is spline-fitted with the sealing sleeve 4, the expansion seat 5 can move axially with respect to the sealing sleeve 4, and the upper joint 7 can be detachably connected with the expansion seat 5 through threads. Either of the expansion seat 5 and the sealing sleeve 4 is formed with a spline, and the other is formed with a spline groove. When the lower end of the expansion seat 5 is inserted into the sealing sleeve 4, the spline is located in the spline groove to restrict the rotation of the expansion seat 5 with respect to the sealing sleeve 4 but allow the relative axial movement between the expansion seat 5 and the sealing sleeve 4. If any unexpected objects (junks or rock caves) exist between the expandable tubular 8 and the wellbore and restrict the expansion of the expandable tubular 8 (unexpanded portion), the expansion cone 6 and the expansion seat 5 can't continue moving upward with respect to the expandable tubular 8. In such a case, the expansion seat 5 can be reinserted into the sealing sleeve 4 to realize spline fit by moving it downward by means of the drill string, and then the drill string may be rotated to drive the upper joint 7 to rotate, so that the upper joint 7 can disengage from the threaded connection with respect to the expansion seat 5, thus the drill string and the upper joint 7 can be taken out of the expandable tubular 8, as shown in FIG. 5. Of course, if the expandable tubular 8 is jammed by the unexpected objects (junks or rock caves) between the expandable tubular 8 and the wellbore before the expandable tubular 8 starts to expand and the expansion seat 5 lefts the sealing sleeve 4, the drill string and the upper joint 7 may be directly rotated so that the upper joint 7 disengages from the threaded connection with the expansion seat 5.

Optionally, the guide shoe 1 comprises a tubular portion inserted into the expandable tubular 8 and a ball head portion located outside the expandable tubular 8, a stepped surface supporting the lower end of the expandable tubular 8 is formed between the ball head portion and the tubular portion, and the tubular portion is connected with the expandable tubular 8 through threads. As shown in FIGS. 1-5, the outer diameter of the ball head portion decreases from top to bottom, thus it is easier to insert the ball head portion into a well or other narrow space and guide the expandable tubular 8. The stepped surface between the ball head portion and the tubular portion can provide upward supporting force for the expandable tubular 8, so that the expandable tubular 8 is mainly directly supported by the guide shoe 1 instead of the expansion cone 6, and the expandable tubular 8 is prevented from being accidentally expanded when acting on the expansion cone 6.

Specifically, the expandable tubular 8 comprises a first section, a second section, and a third section, which are sequentially arranged from bottom to top, wherein the outer diameter of the first section is greater than that of the third section, and the outer diameter of the second section is reduced in the direction from the first section to the third section. As shown in FIG. 1, the first section is a section that has been pre-expanded, the third section is a section to be expanded, and the second section is a transition between the first section and the third section to facilitate expansion by means of the expansion cone 6.

Furthermore, the expansion cone 6 is supported on the upper side of the expansion seat 5, and the expansion cone 6 is at least partially positioned in the second section. The expansion seat 5 can support the expansion cone 6 upward, and, under the pressure of drilling fluid, the expansion seat 5 can push the expansion cone 6 upward. The expansion cone 6 has a conical surface, which may be located in or under the second section. When the expansion cone 6 moves downward, the conical surface can act on the conical inner surface of the second section to continuously "push" the position of the second section upward, so as to realize the expansion of the expandable tubular 8.

Specifically, the drill string comprises a work drill string 10 and a double-box connector 9 connected to the lower end of the work drill string 10, wherein the double-box connector 9 can be clamped to the upper joint 7. The work drill string 10 is the main body portion of the drill string, and the double-box connector 9 is a connecting structure for connecting the upper joint 7 and the work drill string 10. The two ends of the double-box connector 9 may be formed with a female buckle (or a male buckle) respectively, and the lower end of the work drill string 10 is formed with a male buckle (or a female buckle) to be in snap-fit with the upper end of the double-box connector 9, and the upper end of the upper joint 7 is formed with a male buckle (or a female buckle) to be in snap-fit with the lower end of the double-box connector 9.

While the present invention is described above in detail in some preferred embodiments with reference to the accompanying drawings, the present invention is not limited to those embodiments. Different simple variations can be made to the technical scheme of the present invention within the scope of the technical concept of the present invention, including combining the specific technical features in any proper way. Various possible combinations are not described in the present invention, in order to avoid unnecessary repetitive description. However, such simple variations and combinations shall also be deemed as having been disclosed and falling in the scope of protection of the present invention.

The invention claimed is:

1. An expansion tool assembly for expandable tubular, comprising:

an expandable tubular;

a guide shoe partially inserted into and connected to the lower end of the expandable tubular;

a sealing sleeve arranged in the expandable tubular and connected to the upper end of the guide shoe;

an expansion assembly comprising an expansion cone and an expansion seat disposed inside the expandable tubular, wherein the lower end of the expansion seat is connected with hooks, which are configured to rest on the upper end of the sealing sleeve; and an upper joint that is connected to the upper end of the expansion seat and is be connected to a drill string wherein the lower end of the expansion seat is connected with a plurality of hooks arranged at an interval in the circumferential direction, the inner wall of the upper end of the sealing sleeve is provided with grooves, and the hooks are inserted into the upper end of the sealing sleeve and rest in the grooves.

2. The expansion tool assembly for expandable tubular according to claim 1, wherein the hooks can move elastically in the radial direction.

3. The expansion tool assembly for expandable tubular according to claim 2, comprising a plug seat disposed inside the expandable tubular, wherein the lower end of the plug seat is connected to the guide shoe, and the plurality of hooks surround the plug seat.

4. The expansion tool assembly for expandable tubular according to claim 3, wherein the outer circumferential surface of the plug seat is provided with annular protrusions for supporting the hooks.

5. The expansion tool assembly for expandable tubular according to claim 4, wherein the upper end of the plug seat is sealingly inserted into the expansion seat, the lower end of the plug seat is sealingly inserted into the guide shoe, and the plug seat and the guide shoe are connected via a radially extending shear pin, wherein the plug seat can shear off the shear pin under the action of downward pressure and move downward with respect to the guide shoe to disengage from the expansion seat, after the annular protrusions disengage from the hooks.

6. The expansion tool assembly for expandable tubular according to claim 5, comprising a drill string plug that is configured to be displaced along the drill string and move into the plug seat under the action of downward pressure and exert downward pressure on the plug seat.

7. The expansion tool assembly for expandable tubular according to claim 5, wherein the lower end of the expansion seat is spline-fitted with the sealing sleeve, the expansion seat is moveable axially with respect to the sealing sleeve, and the upper joint is detachably connectable with the expansion seat through threads.

8. The expansion tool assembly for expandable tubular according to claim 1, wherein the guide shoe comprises a tubular portion inserted into the expandable tubular and a ball head portion located outside the expandable tubular, a stepped surface supporting the lower end of the expandable tubular is formed between the ball head portion and the tubular portion, and the tubular portion is connected with the expandable tubular through threads.

9. The expansion tool assembly for expandable tubular according to claim 1, wherein the expandable tubular comprises a first section, a second section, and a third section, which are sequentially arranged from bottom to top, wherein the outer diameter of the first section is greater than that of the third section, and the outer diameter of the second section is reduced in the direction from the first section to the third section.

10. The expansion tool assembly for expandable tubular according to claim 9, wherein the expansion cone is supported on the upper side of the expansion seat, and the expansion cone is at least partially positioned in the second section.

11. The expansion tool assembly for expandable tubular according to claim 1, wherein the drill string comprises a work drill string and a double-box connector connected to the lower end of the work drill string, wherein the double-box connector can be is clamped to the upper joint.

* * * * *